US008041563B2

(12) United States Patent
Takeuchi et al.

(10) Patent No.: US 8,041,563 B2
(45) Date of Patent: Oct. 18, 2011

(54) APPARATUS FOR CODING A WIDEBAND AUDIO SIGNAL AND A METHOD FOR CODING A WIDEBAND AUDIO SIGNAL

(75) Inventors: Hirokazu Takeuchi, Tokyo (JP); Kimio Miseki, Tokyo (JP); Masataka Osada, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1138 days.

(21) Appl. No.: 11/825,636

(22) Filed: Jul. 5, 2007

(65) Prior Publication Data

US 2008/0010064 A1 Jan. 10, 2008

(30) Foreign Application Priority Data

Jul. 6, 2006 (JP) ..... 2006-187123

(51) Int. Cl.
*G10L 19/02* (2006.01)
*G10L 11/06* (2006.01)

(52) U.S. Cl. ..... 704/229; 704/210

(58) Field of Classification Search ..... 704/229, 704/230, 500, 210
See application file for complete search history.

(56) References Cited

U.S. PATENT DOCUMENTS 5,150,387 A * 9/1992 Yoshikawa et al. ..... 375/240
2004/0024596 A1* 2/2004 Carney et al. ..... 704/220
2005/0177364 A1* 8/2005 Jelinek ..... 704/214

FOREIGN PATENT DOCUMENTS

JP 03-191618 A 8/1991

* cited by examiner

*Primary Examiner* — Angela A Armstrong
(74) *Attorney, Agent, or Firm* — Holtz, Holtz, Goodman & Chick, P.C.

(57) ABSTRACT

Activity is determined for each frequency band in a frame, and when it is determined that an activity-OFF state has not continued for a predetermined number of times for preceding frames, normal coding processing is performed for the frequency band. When it is determined that the activity-OFF state has continued for the predetermined number of times or more, DTX coding is performed for the frequency band. After this processing has been performed for all of the bands of one frame, a total power of the one entire frame and the power of the band or bands to which the DTX coding is applied are calculated. Subsequently, a new target bit value is calculated based on a ratio of the total power of the one entire frame and the power of the band or bands to which the DTX coding is applied.

14 Claims, 8 Drawing Sheets

APPARATUS FOR CODING A WIDEBAND AUDIO SIGNAL AND A METHOD FOR CODING A WIDEBAND AUDIO SIGNAL

CROSS-REFERENCE TO RELATED APPLICATION

This application is based on and claims the benefit of priority from the prior Japanese Patent Application No. 2006-187123, filed on Jul. 6, 2006, the entire contents of which are incorporated herein by reference.

BACKGROUND OF THE INVENTION

1. Field of the Invention

The present invention relates to an audio signal coding apparatus and an audio signal decoding apparatus capable of reducing the number of bits contained in a coded wideband audio signal.

2. Description of the Related Art

A speech signal compressing/coding method such as AMR (Adaptive Multi-Rate) defines that a coding bit rate can be changed frame by frame based on the detected signal activity.

In the AMR method, in order to reduce transmission power, it is detected whether the activity of an input signal to be coded is voice or not in units of coding, that is, frame by frame (VAD control), and when the input signal is determined as being voice, the input signal is transmitted in the form of a normal audio coded frame, whereas when the input signal is determined not to be voice, only the basic information of the frame is transmitted discontinuously (DTX (Discontinuous Transmission) control) in the form of a comfort noise frame. However, because the DTX control is executed in frames, when this method is applied to a wideband signal such as an audio signal, the DTX control is performed for the whole band to determine whether the activity is present in the input signal.

FIGS. 8A and 8B are views showing transition of the output bit rate, for example, when the DTX control of the AMR method is applied to a wideband audio signal. FIG. 8A indicates power of an audio signal in each frequency band in units of frames on the time axis. The frequency bands without the activity are illustrated by hatching. For instance, a frame F1 contains a plurality of frequency bands all having activity. A frame F2 contains a plurality of frequency bands all having no activity. A frame F3 and a frame F4 contain a plurality of frequency bands having no activity in part of the frequency bands. In this case, only the frame F2 has no frequency band with activity in the whole bandwidth and is recognized as a frame to be subject to the DTX control. Thus, the output bit rate of the frame F2 can be reduced to a low rate through a discontinuous transmission (DTX control) as a comfort noise frame. However, since the frames F3 and F4 contain frequency bands with activity, the frames F3 and F4 are not recognized to be subject to the DTX control. That is, since frames F3 and F4 do not deal with non-audio signal of the AMR method in spite of the presence of the frequency bands without the activity, the discontinuous transmission (DTX control) is not performed.

In addition, according to the MPEG2 audio standards, the AAC (Advanced Audio Coding) method adopting the time-to-frequency transform coding is used.

FIGS. 9A and 9B are views used to describe a bit rate in the AAC method. FIG. 9A is the same as FIG. 8A. Although the function of performing a discontinuous transmission is not incorporated in the AAC method, the AAC method is a variable length frame method by which the number of bits per frame can be changed according to the signal characteristic of each frame, and an instantaneous coding rate for each frame is variable (corresponding to a solid line in FIG. 9B) . The number of bits per frame is determined by taking into account the characteristic of a signal and the buffer model (a bit reservoir serving as a buffer to manage a cumulative difference between the number of bits used in frames in the past and an average number of bits based on a target rate) in reference to the number of bits based on the target rate set from the outside (corresponding to a dotted line in FIG. 9B), and the coding rate is controlled to reach the target rate on average.

For example, in the case of the frame F2, which contains frequency bands without the activity (only a slight number of bits is required), even when the number of bits is reduced for this frame,, as is indicated by a hollow arrow, a surplus number of bits is used for another frame. Also, in the case of the frames F3 and F4, which contain frequency bands without the activity in part of the frequency bands, even when the number of bits is reduced for such a frequency band or the frame containing such a frequency band with no activity, as is indicated by a hollow arrow, bits are allocated to the other frequency bands or to another frame. Hence, as is shown in FIG. 9B, even when there are many signals that require only a slight number of bits (with fewer activities), the resulting number of bits is the number of bits based on the pre-set target rate and a total coding rate is not reduced. This method is therefore by no means efficient.

A variable rate coding method for controlling the coding bit rate frame by frame is disclosed in Jpn. Pat. Appln. KOKAI Publication No. 3-191618. In this coding method, variable rate control is performed for an SNR, whichmeans sound quality, to be constant. In addition, a signal sequence, such as an audio, is divided into plural frequency bands, and the number of bits is controlled for each frequency band on the basis of signal power in each frequency band. It should be noted, however, that because the presence or absence of an audio is determined in the whole frequency bands and a sum of coding quantities of the entire frame is controlled, the control is not performed for each frequency band. This method is therefore a technique that is the same as the AMR method.

The coding method in the related art has a problem that the rate control cannot be performed finely and bands cannot be utilized efficiently.

SUMMARY OF THE INVENTION

The present invention has been made to solve this problem, and it is an object of the present invention to reduce a number of bits by utilizing the bands efficiently for a wideband audio signal.

According to one aspect of the present invention, an apparatus for coding a wideband audio signal is provided which comprising: first dividing means for dividing the wideband audio signal into a plurality of frames; second dividing means for dividing each frame divided by the first dividing means into a plurality of frequency bands; detecting means, for each frequency band, for detecting whether there is activity in each frequency band, based on noise characteristics; first coding means for quantizing the frequency bands and variable length coding the quantized frequency bands; second coding means for transforming a spectrum of the frequency bands into a parameter; determining means for determining which one of the first coding means and second coding means each of the frequency bands is subject to based on the detected activity; calculating means for calculating a first characteristic of one frame and a second characteristic of all frequency bands subject to coding by the second coding means in the one frame; and adjusting means for adjusting a target code amount to be used by the first coding means based on a ratio of the first characteristic and the second characteristic.

DETAILED DESCRIPTION

Figure 1:
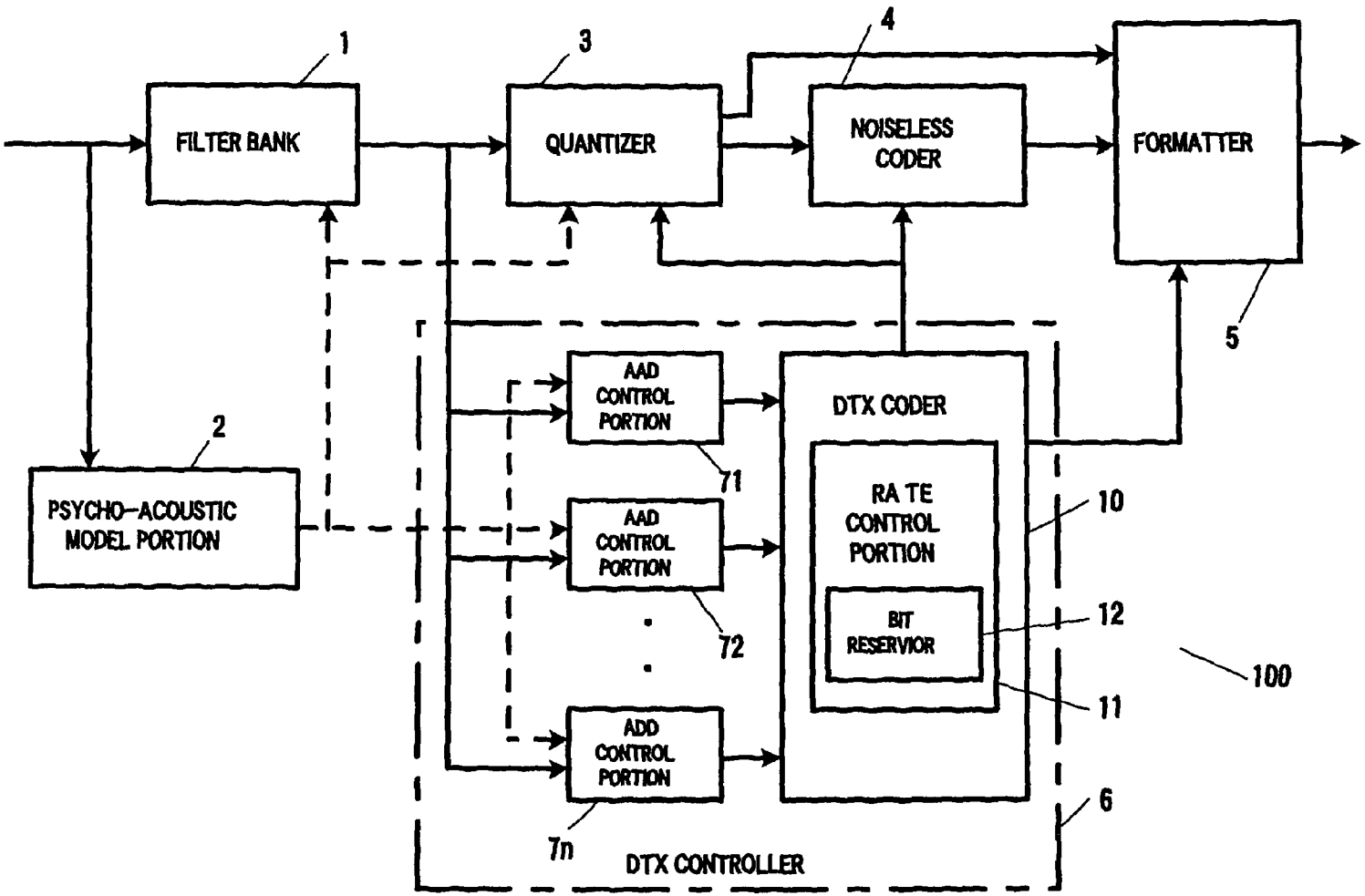
FIG. 1 shows a block diagram of a coding processing portion according to this invention.

FIG. 1 shows a block diagram of a coding processing portion according to one embodiment of the invention. A coding processing portion 100 for a wideband signal comprises a filter bank 1, a psycho-acoustic model portion 2, a quantizer 3, a noiseless coder 4, a formatter 5, and a DTX controller 6. Further, the DTX controller 6 includes AAD (Audio Activity Detection) control portions (activity detection portions) 70, 71, . . . , 7*n*, and a DTX coder 10. The number of AAD control portions (three of which are shown in FIG. 1) corresponds to the number of the divided frequency bands. A rate control portion 11 contains a buffer (not shown) that stores a cumulative difference between the number of bits used for the frames in the past and an average number of bits based on the target bit rate, and includes a bit reservoir 12 to accumulate surplus bits for each frame.

The filter bank 1 performs processing to transform an input signal to be coded to a spectral coefficient in a frequency domain. The psycho-acoustic model portion 2 converts the input signal to a frequency-domain signal and divides the frequency -domain signal into frequency bands f0, f1, . . . , fn, and calculates PE (Perceptual Entropy), an SMR (Signal to Mask Ratio), and unpredictability measure for each of frequency bands f0, f1, . . . , fn, divided at regular intervals in terms of audibility from the spectral coefficient and the auditory characteristic. These calculation results are used for the adaptive block switching performed at the time of quantization and the filter bank processing to suppress pre-echoes. The sequence of processing is defined in the encoder section in ANNEX B of the ISO/IEC 13818-7 MPEG-2 AAC standards, the contents of which are incorporated herein by reference.

The quantizer 3 calculates a quantization step size for each frequency band on the basis of the number of bits per frame acquired from rate control information and the SMR from the psycho-acoustic model portion 2, and quantizes each spectral coefficient on the basis of the quantization step size. The noiseless coder 4 performs entropy coding, such as Huffman coding, and sectioning in order to reduce logical redundancy for a signal of the quantized spectral coefficients. In this instance, it will be described that the Huffman coding is applied for coding the quantized spectral coefficients. Consequently, noiseless coded spectral coefficients outputted from the noiseless coder 4 are the Huffman codes. The formatter 5 multiplexes the Huffman codes, the quantization step size, coded DTX control information, and so on, and generates frames containing the multiplexed information to be transmitted to a network.

The DTX controller 6 divides the spectrum signal into frequency bands f0, f1, . . . , fn at regular intervals in terms of auditory frequency resolution (Bark scale or the like). The AAD control portion 70 of the DTX controller 6 performs audio activity detection for the frequency band f0. The audio activity detection is achieved, for example, by comparing the unpredictability measure for the frequency band f0 derived from the psycho-acoustic model portion 2 with threshold, to determine whether the frequency band f0 is a noise-like signal. The AAD control portion 70 then saves the AAD determination result as AAD flag information (for example, normal signal: ON, noise-like signal: OFF) of the frequency band f0.

The AAD control portion 71 performs the audio activity detection for the frequency band fl and saves the result as AAD flag information of the frequency band fl in the same manner as described above. The AAD control portion 7*n* performs the audio activity detection for the frequency band fn and saves the result as AAD flag information of the frequency band fn in the same manner as described above.

The DTX coder 10 in the DTX controller 6 first determines, for each frequency band, one of a first coding mode of executing normal coding processing, a second coding mode of coding DTX control information for the divided frequency band, and a third coding mode of executing no coding processing, based on the AAD flag information in the AAD control portions 70 through 7*n*, and executes the determined the second mode of processing if the second mode of coding DTX control information is selected. The DTX control information of the divided frequency band includes a DTX control flag identifying that the frequency band is subject to the DTX control for the divided frequency band and parameters indicating the spectrum of the frequency band to be coded. The coded DTX control information such as coded DTX control flag and coded parameters coded by the DTX coder 10 are outputted to the formatter 5. Upon completing the processing as described above for all the frequency bands, the rate control portion 11 corrects the bit rate in response to the degree of being selected the second mode to the respective frequency bands. To correct the bit rate, the rate control portion 11 calculates rate control information and outputs the rate control information to the quantizer 10 and noiseless coding coder 4.

Figure 2:
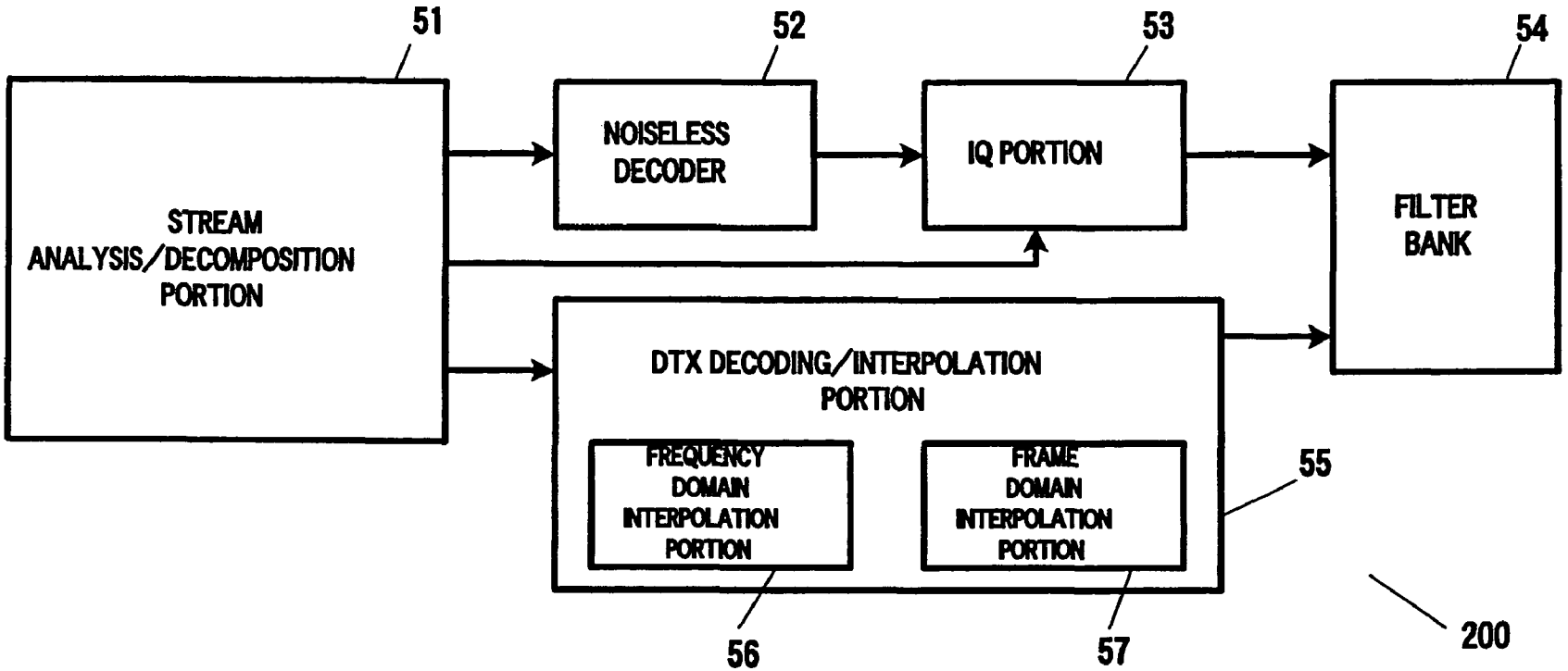
FIG. 2 shows a block diagram of a decoding processing portion according to this invention.

FIG. 2 shows a block diagram of a decoding processing portion according to one embodiment of the invention. A decoding processing portion 200 for a wideband signal comprises a stream analysis/decomposition portion 51, a noiseless decoder 52, an inverse quantization (IQ) portion 53, a filter bank 54, and a DTX decoding/interpolation portion 55. Further, the DTX decoding/interpolation portion 55 includes a frequency domain interpolation portion 56 and a frame interpolation portion 57.

The stream analysis/decomposition portion 51 analyses and decomposes the multiplexed information contained in received frames, and extracts the Huffman codes, the quantization step size, the coded DTX control information, and so on. Subsequently, the Huffman codes are inputted into the noiseless decoder 52, the quantization step size is inputted into the inverse quantization portion 53, and the coded DTX control information is inputted into the DTX decoding/interpolation portion 55, respectively. The noiseless decoding portion 52 decodes the Huffman codes and extracts a physical quantity, such as quantized spectral coefficients. The inverse quantization portion 53 performs inverse quantization processing on the extracted quantized spectral coefficients pursuant to the quantization step size received from the stream analysis/decomposition portion51 and restores the spectral coefficients. The filter bank 54 transforms the spectral coefficients from the inverse quantization portion 52 into a time-domain PCM signal. This time-domain PCM signal corresponds to the input signal having been inputted into the filter bank 1.

For each band, the DTX decoding/interpolation portion 55 decodes the coded DTX control information and extracts the DTX control flag and parameters. Subsequently, the DTX decoding/interpolation portion 55 determines whether the frequency band is subjected to the DTX control for the divided frequency band with reference to the DTX control flag. The frequency domain interpolation portion 56 performs the frequency domain interpolation processing. The frame interpolation portion 57 performs the frame interpolation processing. The processing described above is performed for all the frequency bands.

First Embodiment

Figure 3:
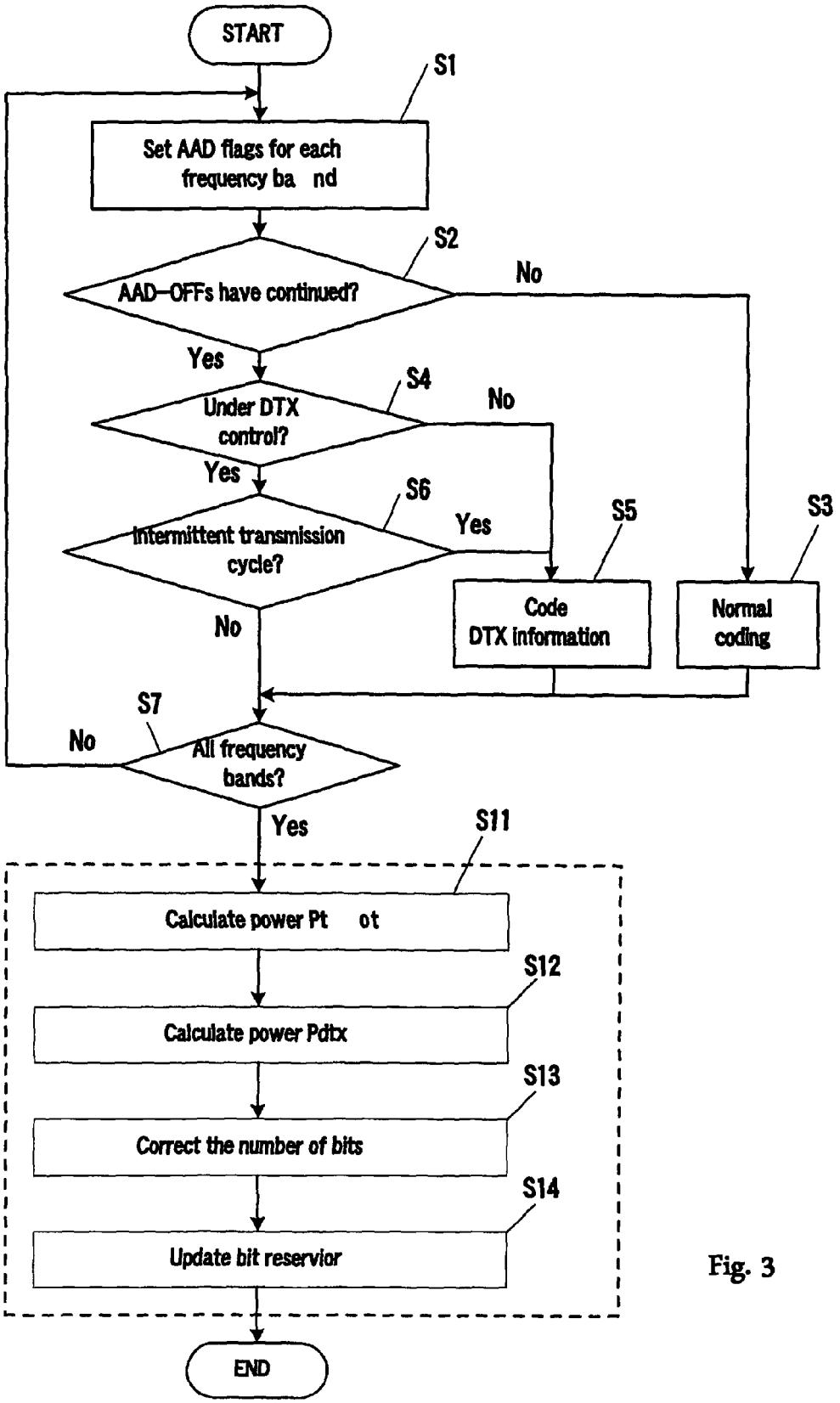
FIG. 3 shows a flowchart of coder divided band DTX processing by the coding processing portion according to one embodiment (method 1) of the invention.

FIG. 3 is a flowchart showing DTX processing for the frequency bands executed by the coding processing portion 100 according to first embodiment of the invention. The AAD control portions 70, 71, . . . ,7*n* perform the activity detection for the frequency bands f0, f1, . . . , fn, by the AAD determination and set the AAD flags respectively. The AAD flag is set ON for a signal with the activity and OFF for a noise-like signal (Step S1).

Then, the DTX coder 4 first determines which of the first coding mode or the second coding mode is to be executed on the basis of the AAD flag for the frequency band f0. More specifically, it is determined whether the AAD determination results for preceding frames show that AAD-OFF (the AAD flag has been set to OFF) has continued for a predetermined number of times or more. When AAD-OFF has continued for the predetermined number of times or more, the frequency band is determined as being subject to the DTX control for the divided frequency band (the second coding mode), and when AAD-OFF has continued for less than the predetermined number of times, the frequency band is determined as being subject to the normal coding processing (the first coding mode) (Step S2). When the AAD determination result in Step S2 shows that AAD-OFF has continued for less than the predetermined number of times (NO in Step S2), the normal coding processing (e.g. scaling processing) is performed by the quantizer 3 and noiseless coder 4 (Step S3).

When the AAD determination result in Step S2 shows that AAD-OFF has continued the predetermined number of times or more (YES in Step S2), the DTX coder 10 determines that the frequency band is subject to the DTX control for the divided frequency band. If the DTX control for the divided frequency band is determined to be executed, the DTX coder 10 checks whether the frequency band is already placed under the DTX control for the divided frequency band is determined (Step S4). When it is determined in Step S4 that the frequency band is not placed under the DTX control for the divided frequency band (NO is Step 4), the DTX control information (discontinuous transmission control information) is coded by the DTX coder 10 for the intended frequency band (band f0) (Step S5). The DTX control information includes the DTX control flag identifying the frequency band as being subject to the DTX control for the divided frequency band and parameters corresponding to parameterized spectrum. The parameterized spectrum can be, for example, the average power information.

On the other hand, when it is determined that the frequency band is already placed under the DTX control for the divided frequency band (YES in Step S4), whether the current frame is in the default discontinuous transmission cycle or the default cycle responding to the AAD determination result is determined by the DTX coder 10 (Step S6). When the current frame is in the default cycle (YES in Step S6), the DTX control information is newly coded to update the DTX control information (Step S5). When it is determined in Step S6 that the current frame is not in the default cycle (NO), the DTX coder 10 does not code the DTX control information. The processing for the frequency band f0 is completed by the processing described above. Herein, the cycle in which the divided band DTX control information is transmitted can be the default cycle as described above, or alternatively, it can be changed adaptively in response to the signal characteristic.

The processing as described above is performed for each frequency band until the processing is completed for all the frequency bands f0, f1, . . . , fn (Step S7).

Subsequently, the rate control is corrected according to the degree of application of the DTX control for the divided frequency band to the respective frequency bands. The correction of the rate control is executed by the rate control portion 11 and is a method by which a correction is made by reducing the number of bits in response to a ratio of the total power for each frame and the power of the DTX applied band. Initially, power Ptot of one entire frame is calculated from the spectrum information (Step Sll). Further, power Pdtx of a signal in the frequency band to which the DTX control for the divided frequency band is applied is calculated (Step S12).

Generally, an allocated number of bits Bfrm to each frame is calculated by the rate control portion 10 in advance from the parameter from the psycho-acoustic model portion 2, the capacity of the bit reservoir 12, and so forth. In the case of the DTX control for the divided frequency band, however, in order to utilize the frequency bands efficiently by means of discontinuous transmission, it is controlled to lower the coding rate (the number of bits for each frame) by the number of bits comparable to the frequency band signal component that will not be transmitted by the DTX control. To this end, the number of bits is weighted on the basis of the power information for each frequency band, and in order to subtract the number of bits comparable to the number of bits applied to the DTX control from the number of bits, it is adjusted using the parameters Ptot and Pdtx to an allocated number of bits to each frame after correction, (target)=Bfrm×(1−Pdtx/Ptot), that is allocated to the normal coding (the second coding mode) (Step S13).

The allocated number of bits before correction, Bfrm, is applied to update the capacity of the bit reservoir 12 (Step S14). This is because there is a possibility that when the capacity of the bit reservoir 12 increases as the number o f bits is reduced by the correction, information bits are used excessively in the next and subsequent frames, which makes the efficient utilization of the frequency bands impossible.

According to the first embodiment, it is possible to achieve an allocated amount of codes (target) corresponding to the power of a signal in the frequency band to which the DTX control for the divided frequency band is applied. It is thus possible to reduce an amount of codes.

Second Embodiment

Figure 4:
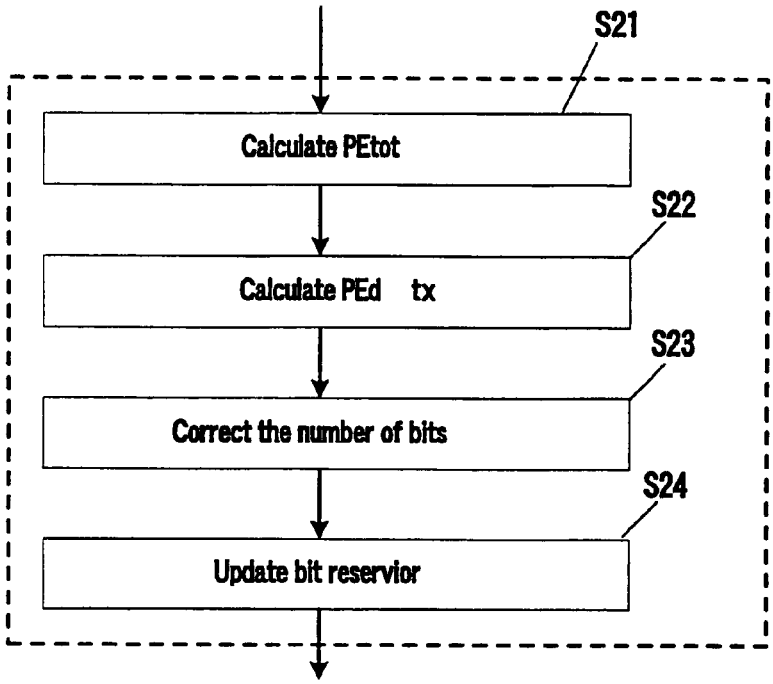
FIG. 4 is a flowchart of the coder divided band DTX processing by the coding processing portion according to first embodiment of the invention.

FIG. 4 is a flowchart showing the DTX processing for the divided frequency band executed by the coding processing portion 100 according to second embodiment of the invention. Herein, the method of correcting bit rate in the flowchart of FIG. 3 in the first embodiment (namely, Steps S11 to S14 surrounded by a dashed-line box in FIG. 3) is replaced with the second embodiment of correcting bit rate, and the rest is the same. Hence, the method of correcting bit rate according to the second embodiment is illustrated and described.

In the method of correcting the bit rate according to the second embodiment, correction is made by reducing the number of bits in response to the ratio of the total PE (Perceptual Entropy) of each frame and the PE in the DTX applied frequency band on the basis of the psycho-acoustic model. The DTX controller 6 first calculates the PE value PEtot of the entire frame obtained from the psycho-acoustic model portion 2 (Step S21). Further, the DTX controller 6 calculates the PE value PEdtx of the frequency band to which the DTX control for the divided frequency band is applied (Step S22). Subsequently, the rate control portion 11 calculates the number of bits Bfrm which is used to correct the allocated number of bits to each frame. To this end, the number of bits is weighted on the basis of the PE value, which is calculated by the psycho-acoustic model portion 2, of each frequency band, and in order to remove the PE value of the frequency band(s) to which the DTX control is applied when calculating the number of bits to be allocated to each frame, the corrected number of bits (target), Bfrm×(1−PEdtx/PEtot), to be allocated to each frame is calculated by the rate control portion 12, based on the parameters PEtot and PEdtx. The calculated Bfrm is used in the normal coding processing (the first coding mode) (Step S23).

The allocated number of bits before correction, Bfrm, is applied to update the capacity of the bit reservoir 12 (Step S24). This is because, as in the first embodiment, there is a possibility that when the capacity of the bit reservoir 12 increases as the amount of codes is reduced by the correction, information bits are used excessively in the next and subsequent frames, which makes the efficient utilization of the frequency bands impossible.

According to the second embodiment, it is possible to achieve an allocated number of bits (target) corresponding to the PE (Perceptual Entropy) of a signal in the frequency band to which the DTX control for the divided frequency band is applied. It is thus possible to reduce the number of bits.

Third Embodiment

Figure 5:
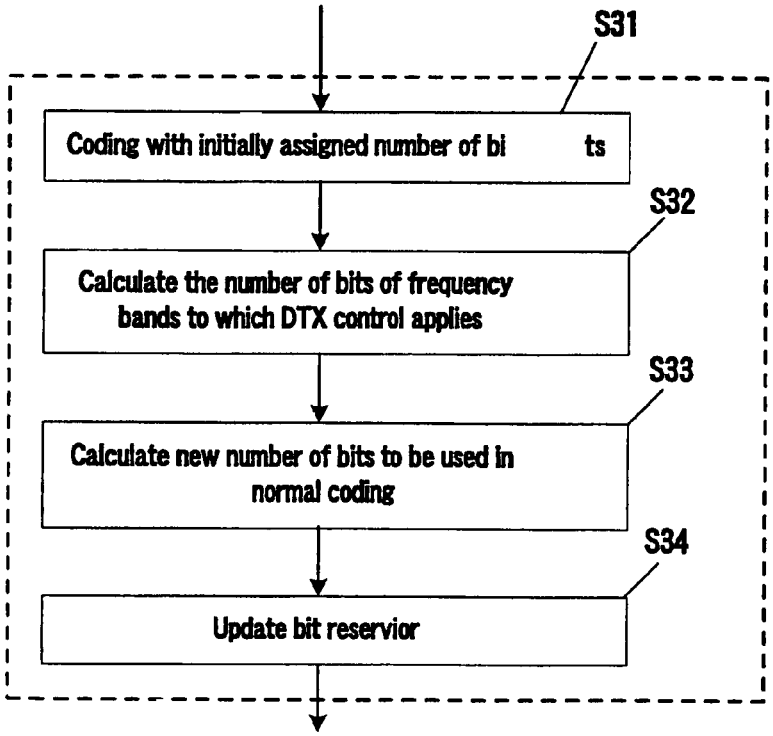
FIG. 5 is a flowchart of the coder divided band DTX processing by the coding processing portion according to second embodiment of the invention.

FIG. 5 is a flowchart of the DTXprocessing for the divided frequency band executed by the coding processing portion 100 according to third embodiment of the invention. Herein, the method of correcting bit rate in the flowchart of FIG. 3 in the first embodiment is replaced with another method of correcting the bit rate, and the rest is the same. Hence, the portion of the method of correcting the bit rate according to the third embodiment is illustrated and described.

The method of correcting the bit rate according to the third embodiment is a method by which corrected number of bits calculated by subtracting the number of bits for the DTX applied frequency band from the number of bits for all the frequency bands. The DTX controller 6 first performs coding with the initially allocated number of bits Bfrm (Step S31). Subsequently, the DTX controller 6 calculates the number of bits Bdtx allocated to the frequency band to which the DTX control is applied (Step S32). Then, the rate control portion 11 calculates the number of bits to be allocated to the normal coding processing (first coding mode) by subtracting Bdtx from Bfrm (Step S33). Coding is performed again with the corrected allocated number of bits. Only the noiseless coding by the noiseless coder 4 is performed, since the quantization step size is reusable.

The allocated number of bits before correction, Bfrm, is applied to update the capacity of the bit reservoir 12 (Step S34). This is because, as in the first embodiment, there is a possibility that when the capacity of the bit reservoir 12 increases as the number of bits is reduced by the correction, information bits are used excessively in the next and subsequent frames, which makes the efficient utilization of the frequency bands impossible.

According to the third embodiment, it is possible to achieve the number of bits from which is subtracted the number of bits Bdtx allocated to the frequency band to which the DTX control is applied. It is thus possible to reduce the number of bits.

Figure 6:
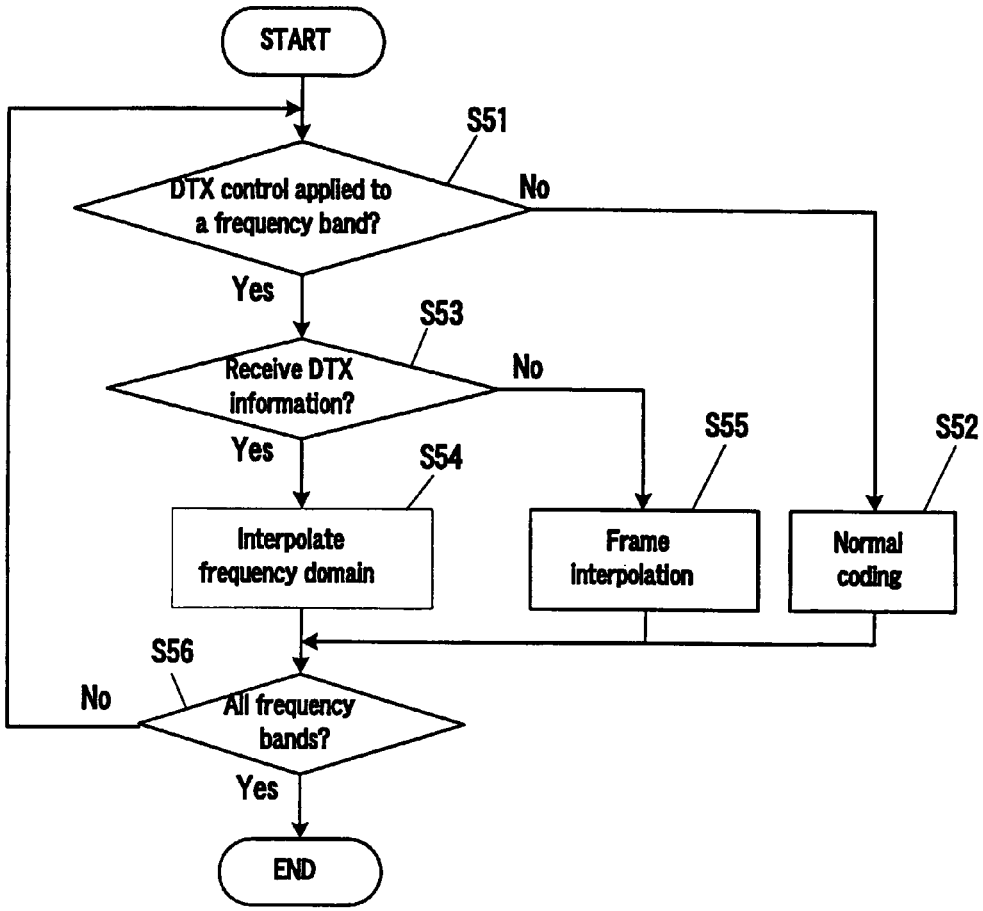
FIG. 6 is a flowchart of decoder divided band DTX processing by the decoding processing portion according to this invention.

FIG. 6 is a flowchart showing the DTX processing for the divided frequency band executed by the decoding processing portion 200 according to this invention. The DTX processing executed by the decoding processing portion 200 is common to the coding processing according to each of the first to third embodiments described above. The DTX decoding/interpolation portion 55 of the decoding processing portion 200 first determines whether the DTX control is applied to the frequency band f0 with reference to the DTX control flag (Step S51). When it is determined that the DTX control is not applied to the frequency band f0 in Step S51 (NO), normal decoding processing is performed by the noiseless decoder 52 and inverse quantization portion 53 on the basis of the Huffman codes extracted by the stream analysis/decomposition portion 51 (Step S52).

On the other hand, when the frequency band f0 is determined as being applied to the DTX control in Step S51 (YES), it is checked whether the DTX control information is included in the present received frame by DTX decoding/interpolation portion 55, that is, it is determined whether the discontinuous transmission timing in the predetermined cycle, which is defined to execute the discontinuous tramsmission, has come (Step S53). If the DTX control information has been received (YES), the spectrum of the intended frequency band (frequency band f0) is interpolated/restored by the frequency domain interpolation portion 56 on the basis of the DTX information (Step S54). For example, if the DTX information is the power information, a signal is restored from a random signal based on calculation that total power of the random signal is closed to the power included in the DTX information.

When it is determined that the DTX information reception timing has not come in Step S53 (NO), the interpolation processing is performed by the frame domain interpolation portion 57 between frames (Step S55). For example, it is performed by the method of updating only a random signal used as the base signal based on the power value of the preceding frame or the method of linear prediction based on the power information in the past. The processing described above is performed for each frequency band until the processing is completed for all the frequency bands (Step S56).

Figure 7A:
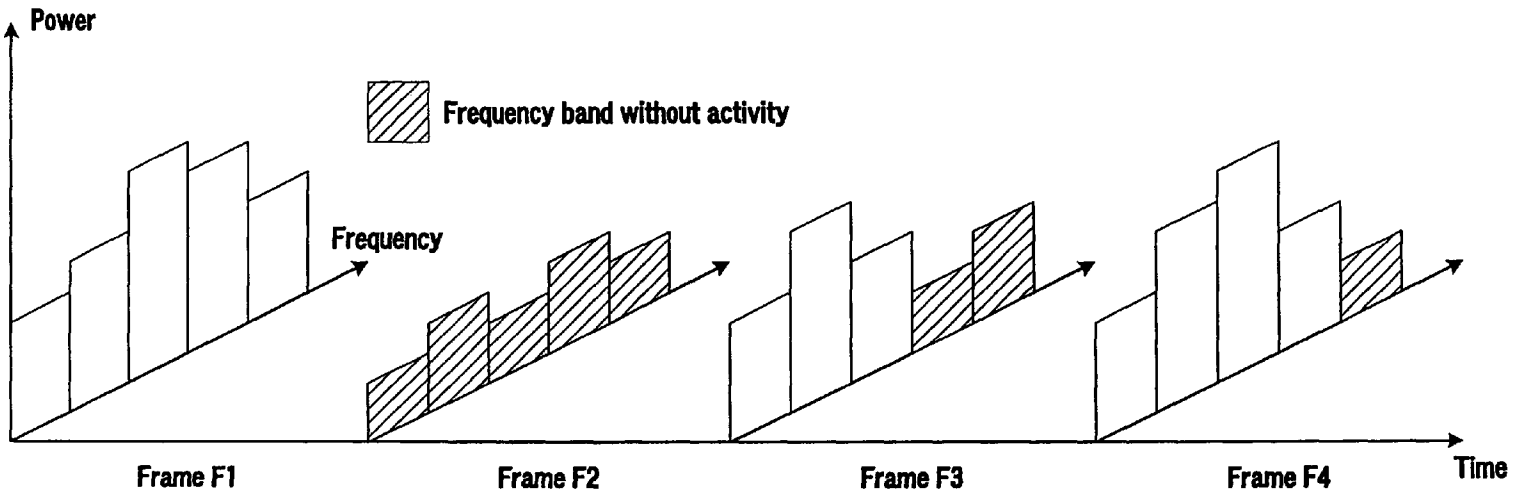
FIGS. 7A and 7B are views used to describe a bit rate in the divided band DTX processing according to this invention.
Figure 7B:
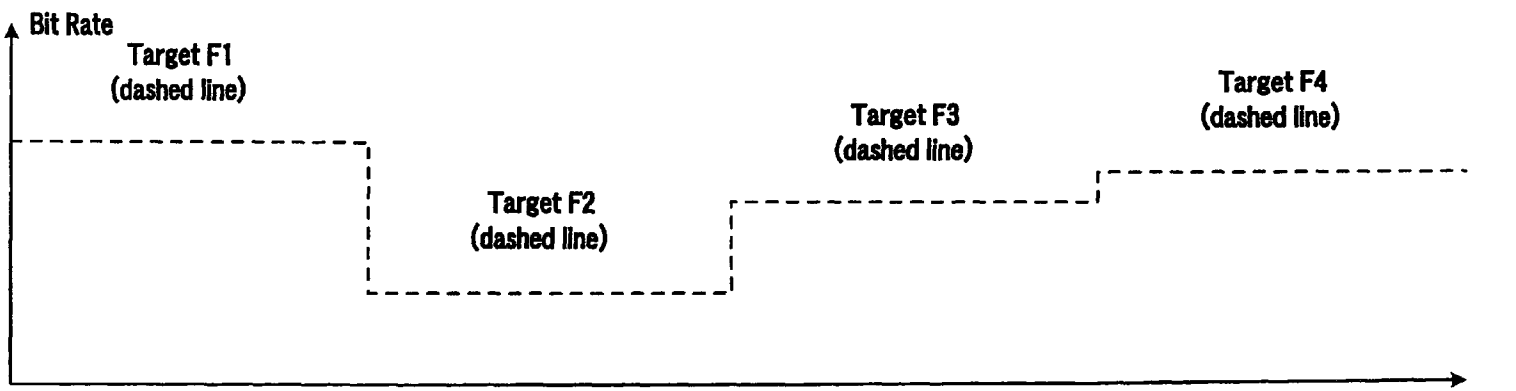
Figure 8A:
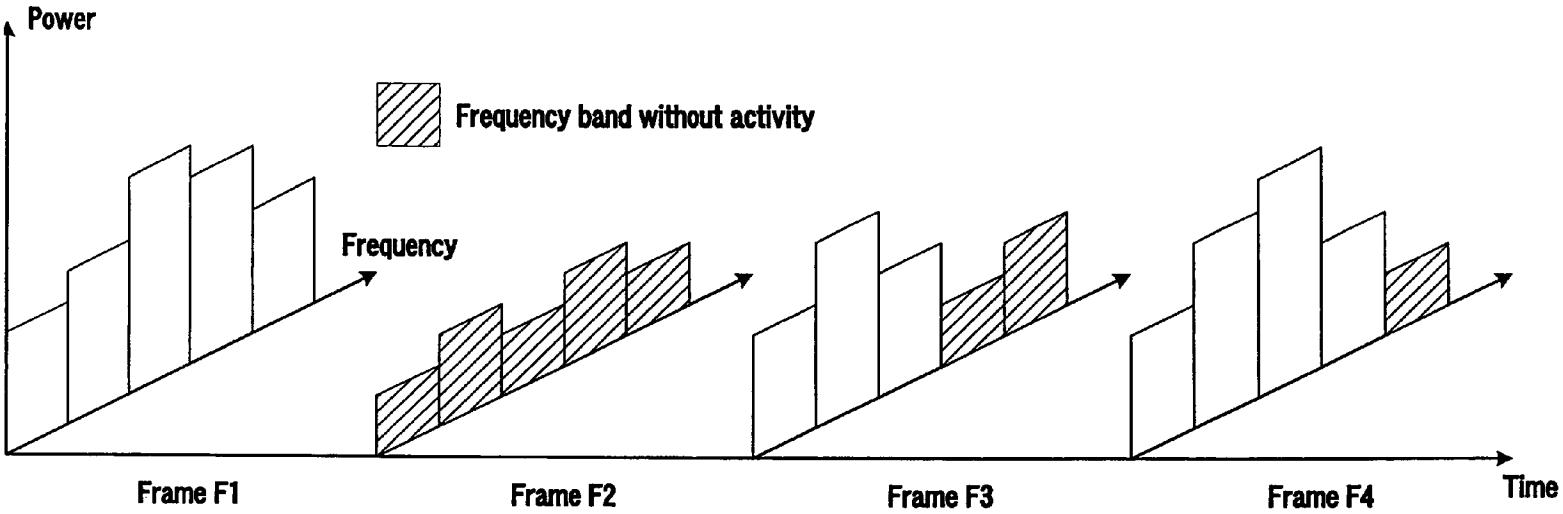
FIGS. 8A and 8B are views showing the transition of an output bit rate when the DTX control of the AMR method in the related art is applied to a wideband audio signal.
Figure 8B:
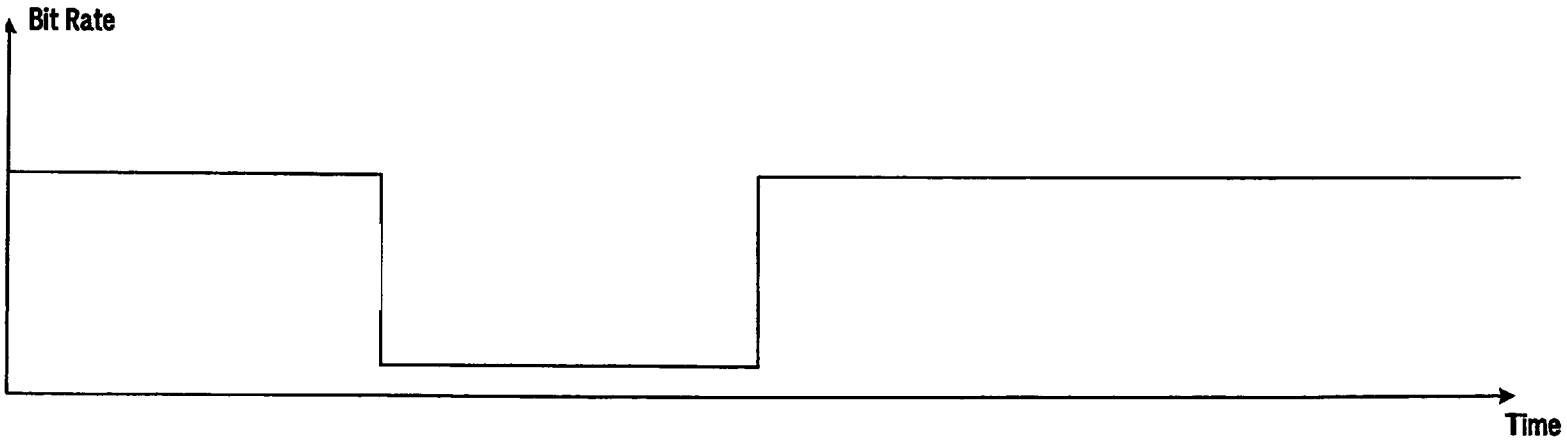
Figure 9A:
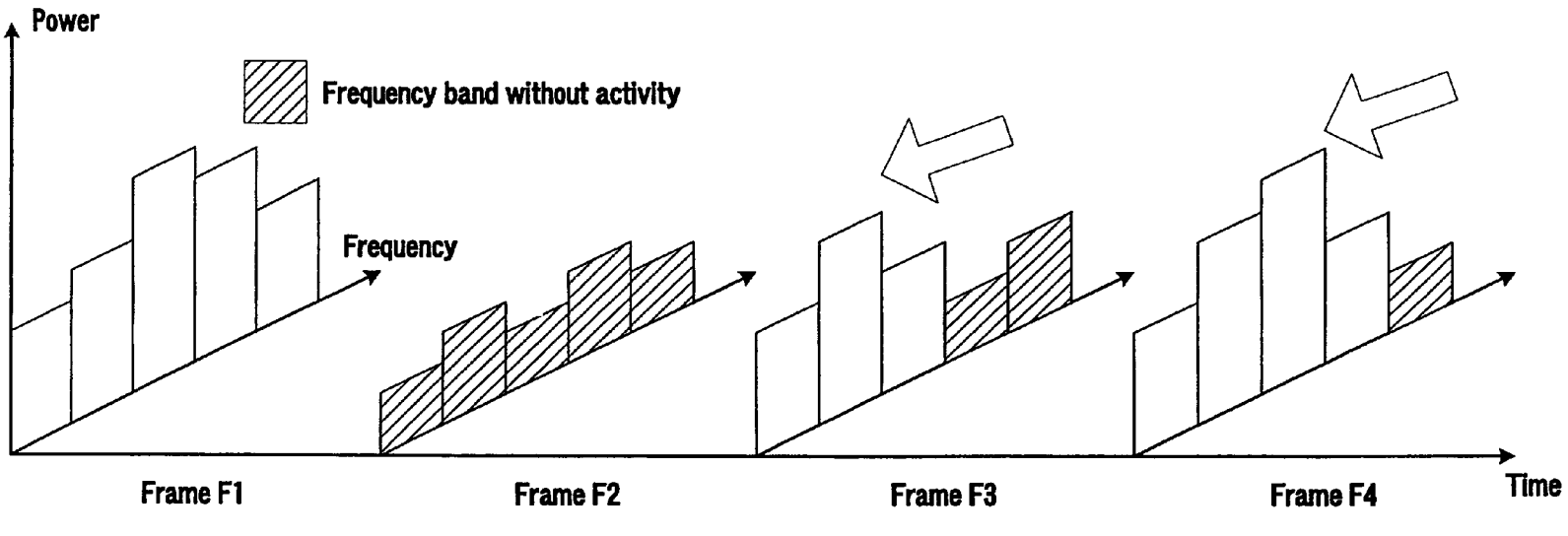
FIGS. 9A and 9B are views used to describe a bit rate of the AAC method in the related art.
Figure 9B:
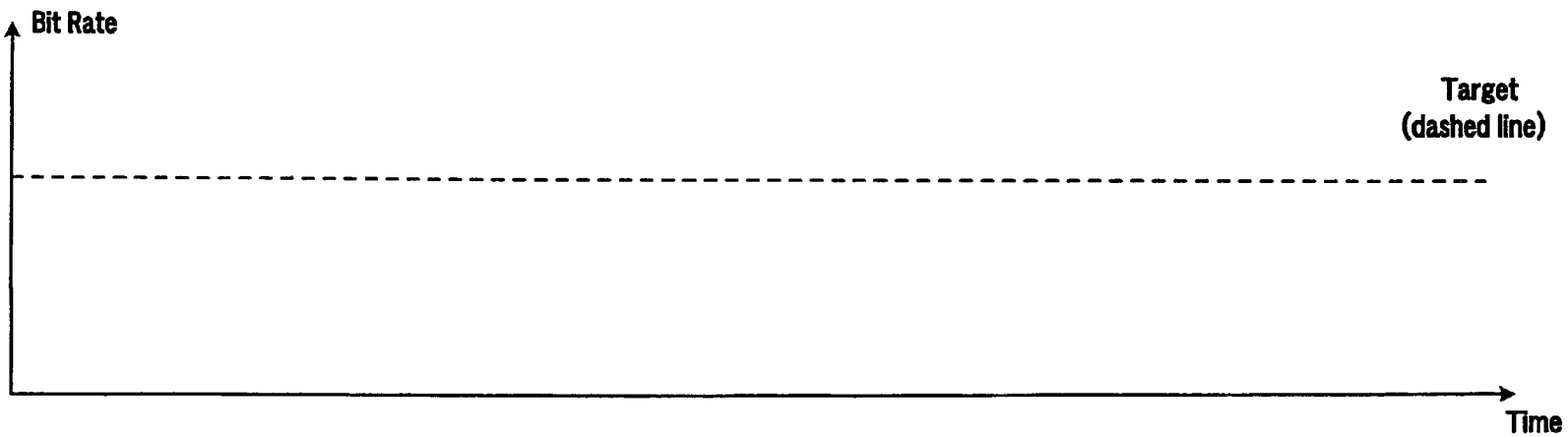

FIGS. 7A and 7B show transition of a bit rate in the DTX processing according to this invention. FIG. 7A is the same as FIG. 8A and FIG. 9A showing examples in the related art, and indicates the power of a wideband audio signal in each frequency band in units of frames on the time axis. A frequency band without the activity is illustrated by hatching. For instance, a frame F1 is a signal with the activity in the whole bandwidth. A frame F2 shows the case of a signal without the activity in the whole bandwidth. A frame F3 shows a case where the activity is absent in part of the bandwidth. A frame F4 also shows a case where the activity is absent in part of the bandwidth.

FIG. 7B shows transition of a bit rate when the DTX control of the invention is applied to coding. A target number of bits allocated to each frame after correction is indicated by a dotted line for each frame. Hereinafter, a description will be given using the DTX coding processing corresponding to the first embodiment as a representative example. The frame F1 is a signal with the activity in the whole bandwidth, and has no frequency band without the activity that is indicated by hatching (no frequency band with an AAD flag determined as being set OFF in the AAD control), thereby having Pdtx=0 as the power of a signal of the frequency band to which the DTX control is applied. Hence, the number of bits (target F1) allocated to the normal coding (first coding mode) for the frame F1 after correction is Bfrm(F1)×(1−Pdtx/Ptot)=Bfrm(F1)×(1−0/Ptot)=Bfrm(F1). In other words, it is a number of bits Bfrm calculated in advance from a number of bits per frame based on the target bit rate, the parameter from the psycho-acoustic model portion 2, the capacity of the bit reservoir 12, and so forth.

The frame F2 comprises frequency bands without the activity (hatched portion) in the whole bandwidth, thereby having Pdtx=Ptot as the power of a signal of the frequency band to which the DTX control is applied. Hence, a number of bits (target F2) allocated to the normal coding (first coding mode) for the frame F2 after correction is Bfrm(F2)×(1−Pdtx/Ptot)=Bfrm(F2)×(1−Ptot/Ptot)=0. In practice, however, because the control bit and the like are necessary, the lowest bit rate is used.

The frame F3 comprises both the frequency bands of a signal with the activity and frequency bands without the activity (hatchedportion). Given 0.4 as the ratio of the power of the DTX applied frequency band and the power of the frame, a number of bits (target F3) allocated to the normal coding (first coding mode) for the frame F3 after correction is Bfrm(F3)×(1−Pdtx/Ptot)=Bfrm(F3)×(1−0.4)=0.6Bfrm(F3).

The frame F4 also comprises both frequency bands of a signal with the activity and a frequency band without the activity (hatchedportion). Given 0.2 as the ratio of the power of the DTX applied frequency band and the power of the frame, a number of bits (target F4) allocated to the normal coding (first coding mode) for the frame F4 after correction is Bfrm(F4)×(1−Pdtx/Ptot)=Bfrm(F4)×(1−0.2)=0.8Bfrm(F4).

According to the embodiments of the invention, it is possible to apply the rate control to an allocated number of bits in response to the power of a signal in the frequency band to which the DTX control is applied. It is thus possible to reduce a number of bits.

What is claimed is:

1. An apparatus for coding a wideband audio signal, comprising:

first dividing means for dividing the wideband audio signal into a plurality of frames;

second dividing means for dividing each frame divided by the first dividing means into a plurality of frequency bands;

detecting means, for each frequency band, for detecting whether there is activity in each frequency band, based on noise characteristics;

first coding means for quantizing the frequency bands and variable length coding the quantized frequency bands;

second coding means for transforming a spectrum of the frequency bands into a parameter;

determining means for determining which one of the first coding means and second coding means each of the frequency bands is subject to based on the detected activity;

calculating means for calculating a first characteristic of one frame and a second characteristic of all frequency bands subject to coding by the second coding means in the one frame; and adjusting means for adjusting a target code amount to be used by the first coding means based on a ratio of the first characteristic and the second characteristic.

2. The apparatus according to claim 1, wherein the determining means determines that the first coding means is to code the frequency bands if the detecting means does not detect the activity for a predetermined number of times in succession.

3. The apparatus according to claim 1, wherein the first characteristic is a first total power of all frequency bands contained in the one frame and the second characteristic is a second total power of every frequency band subject to the second coding means, and wherein the adjusting means adjusts the target code amount to be used by the first coding means based on a ratio of the first total power and the second total power.

4. The apparatus according to claim 1, wherein the first characteristic is a first entropy of the one frame and the second characteristic is a second entropy of every frequency band subject to the second coding means.

5. The apparatus according to claim 1, further comprising redundant code amount storing means for storing a redundant code amount value calculated based on a difference between a target bit value of a frame and a generated bit amount after operation of the second coding means is performed.

6. The apparatus according to claim 5, further comprising updating means for updating the redundant code amount value each time the operation of the second coding means is performed.

7. The apparatus according to claim 1, wherein the second coding means codes flag information indicating that a frequency band is subject to the second coding means.

8. A method for coding a wideband audio signal, comprising:

dividing the wideband audio signal into a plurality of frames;

dividing each frame into a plurality of frequency bands;

detecting, for each frequency band, whether there is activity in the frequency band, based on noise characteristics;

subjecting each of the frequency bands to one of first coding processing comprising quantizing the frequency bands and variable length coding the quantized frequency bands, and second coding processing comprising transforming a spectrum of the frequency bands into a parameter;

determining which one of the first coding processing and second coding processing each of the frequency bands is subject to based on the detected activity;

calculating a first characteristic of one frame and a second characteristic of all frequency bands subject to coding by the second coding processing in the one frame; and adjusting a target code amount to be used in the first coding processing based on a ratio of the first characteristic and the second characteristic.

9. The method according to claim 8, wherein the determining determines that the first coding processing is to be performed to code the frequency bands if the activity is not detected for a predetermined number of times in succession.

10. The method according to claim 8, wherein the first characteristic is a first total power of all frequency bands contained in the one frame and the second characteristic is a second total power of every frequency band subject to the second coding processing, and wherein the adjusting adjusts the target code amount to be used in the first coding processing based on a ratio of the first total power and the second total power.

11. The method according to 8, wherein the first characteristic is a first entropy of the one frame and the second characteristic is a second entropy of every frequency band subject to the second coding processing.

12. The method according to claim 8, further comprising storing a redundant code amount value calculated based on a difference between a target bit value of a frame and a generated bit amount after the second coding processing is performed.

13. The method according to claim 12, further comprising updating the redundant code amount value each time the second coding processing is performed.

14. The method according to claim 8, wherein the second coding processing comprises coding flag information indicating that a frequency band is subject to the second coding processing.

* * * * *